US010714245B2

(12) United States Patent
Chen et al.

(10) Patent No.: US 10,714,245 B2
(45) Date of Patent: Jul. 14, 2020

(54) METHOD FOR PREPARING AN R-T-B PERMANENT MAGNET

(71) Applicant: BEIJING ZHONG KE SAN HUAN HI-TECH CO., LTD., Beijing (CN)

(72) Inventors: Guoan Chen, Beijing (CN); Yugang Zhao, Beijing (CN); Jin Zhang, Beijing (CN); E Niu, Beijing (CN); Haojie Wang, Beijing (CN); Xuanzhang Ye, Beijing (CN)

(73) Assignee: Beijing Zhong Ke San Huan Hi-Tech Co., Ltd., Beijing (CN)

( * ) Notice: Subject to any disclaimer, the term of this patent is extended or adjusted under 35 U.S.C. 154(b) by 346 days.

(21) Appl. No.: 15/484,006

(22) Filed: Apr. 10, 2017

(65) Prior Publication Data

US 2017/0221615 A1 Aug. 3, 2017

Related U.S. Application Data

(63) Continuation-in-part of application No. PCT/CN2015/098012, filed on Dec. 21, 2015.

(30) Foreign Application Priority Data

Dec. 19, 2014 (CN) ..... 2014 1 0800303

(51) Int. Cl.
*H01F 1/053* (2006.01)
*H01F 41/02* (2006.01)
*H01F 1/057* (2006.01)

(52) U.S. Cl.
CPC ..... *H01F 1/0536* (2013.01); *H01F 1/0577* (2013.01); *H01F 41/0266* (2013.01); *H01F 41/0293* (2013.01)

(58) Field of Classification Search
None
See application file for complete search history.

(56) References Cited

U.S. PATENT DOCUMENTS

2005/0268989 A1 12/2005 Tomizawa et al.
2009/0098006 A1* 4/2009 Nakamura ..... B22F 7/02 419/9

(Continued)

FOREIGN PATENT DOCUMENTS

CN 1717755 A 1/2006
CN 102473498 A 5/2012

(Continued)

OTHER PUBLICATIONS

Machine translation of CN103812281A. May 2014. (Year: 2014).*
International Search Report which issued in corresponding PCT application No. PCT/CN2015/098012, dated Mar. 24, 2016.

*Primary Examiner* — Xiaowei Su
(74) *Attorney, Agent, or Firm* — Fish & Richardson P.C.

(57) ABSTRACT

Disclosed herein is a method for manufacturing an R-T-B permanent magnet and the magnet made with the method. The method may include preparation of strip pieces by melting and casting, preparing coarse powder by hydrogen decrepitation of the strip pieces; milling the powder into fine powder; pressing the fine powder is pressed to form a compact, pre-sintering the compact in vacuum or inert gas, machining the pre-sintered block to a desired shape; and dispersing the heavy rare earth compound powder into an organic solvent to prepare a slurry and a second sintering step.

15 Claims, 1 Drawing Sheet

(56) References Cited

U.S. PATENT DOCUMENTS

| | | | | |
|---|---|---|---|---|
| 2012/0114515 | A1* | 5/2012 | Kaneko | B22F 1/0088 419/10 |
| 2012/0176211 | A1 | 7/2012 | Sagawa | |
| 2013/0009503 | A1 | 1/2013 | Iwasaki et al. | |
| 2013/0026870 | A1 | 1/2013 | Baba et al. | |
| 2014/0184370 | A1 | 7/2014 | Hidaka et al. | |
| 2014/0311291 | A1 | 10/2014 | Enokido et al. | |
| 2015/0235750 | A1 | 8/2015 | Miwa et al. | |

FOREIGN PATENT DOCUMENTS

| | | | | |
|---|---|---|---|---|
| CN | 102483979 | A | | 5/2012 |
| CN | 103098151 | A | | 5/2013 |
| CN | 103646772 | A | | 3/2014 |
| CN | 103812281 | A | * | 5/2014 |
| CN | 104112559 | A | | 10/2014 |
| CN | 104112580 | A | | 10/2014 |
| CN | 104137197 | A | | 11/2014 |
| JP | 2007059619 | A | | 3/2007 |
| JP | 2008045148 | A | | 2/2008 |
| JP | 2011211069 | A | | 10/2011 |
| JP | 2015103799 | A | | 6/2015 |
| WO | 2007/088718 | A1 | | 8/2007 |

* cited by examiner

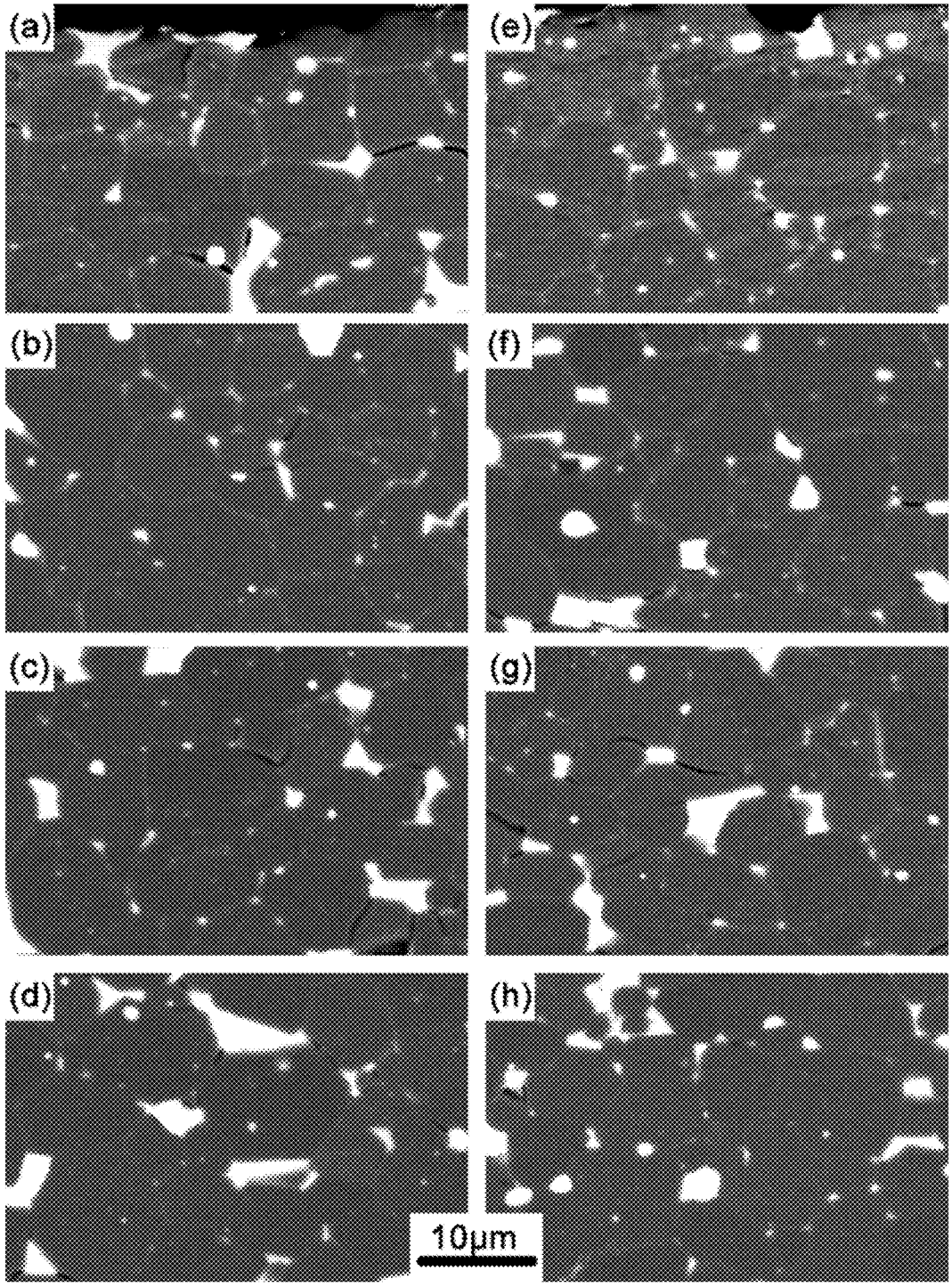
(a)
(b)
(c)
(d)
(e)
(f)
(g)
(h)
10μm

METHOD FOR PREPARING AN R-T-B PERMANENT MAGNET

TECHNICAL FIELD

The invention relates to a method for manufacturing an R-T-B permanent magnet and the permanent magnet produced with this method, particularly to a method for manufacturing R-T-B permanent magnet with high saturation magnetization Br and high coercivity Hcj.

BACKGROUND

As disclosed herein the R of "R-T-B" is one or more rare earth elements, T is one or more transition metal elements, including at least Fe or Co, and B is boron. The R-T-B magnet optionally includes carbon or nitrogen. Due to the high magnetic properties of R—Fe—B permanent magnets, the Nd—Fe—B permanent magnet used in various kinds of motors is also believed to improve the motor's performance, reduce the weight and the size of motor, and achieve energy-saving effect efficiently. Hence, more attention has been paid to Nd—Fe—B permanent magnet applications in motors of automobiles and household appliances. Especially, with the increased demand for energy-saving and environmental protection, using Nd—Fe—B permanent magnetic materials in the motor of hybrid electric vehicles (HEV), electric vehicles (EV) and air conditioning compressors has become commercially practical. Typical requirements for using R—Fe—B sintered permanent magnetic materials in these high performance motors are high saturation magnetization Br, and high coercivity Hcj.

SUMMARY OF THE INVENTION

As mentioned above, the existing technologies for manufacturing an R-T-B permanent magnet focus mainly on the effects of the coating powder and the heat-treatment process, but not on the internal structure of magnet. It has now been discovered that, in addition to the effects of the powder composition that is coated on magnets and the heat-treatment process on the coercivity Hcj of the magnet, the diffusion channel in such magnets could significantly affect the subsequent diffusion of heavy rare earth elements. Experimental studies show that, after the pre-sintering process, the pores in the pre-sintered block are an important diffusion channel, which greatly improves the diffusion effect of heavy rare earth elements. Thus, the present invention is based on the discovery that a R-T-B based permanent magnet having improved coercivity Hcj and/or improved distribution uniformity of heavy rare earth elements (i.e., squareness SQ (HK/Hcj)) can be obtained by pre-sintering a R-T-B compact at a suitable temperature (e.g., 900-1040° C.) for a suitable period of time to obtain a pre-sintered block having sufficient diffusion channels (e.g., having a density of 6-7.4 g/cm$^3$).

An objective of this invention is to provide a method of manufacturing R-T-B sintered permanent magnets with high remanence Br and high coercivity Hcj. The remanence Br and coercivity Hcj of the magnets produced by this method can be significantly higher than those produced by existing methods. Furthermore, in the manufacturing method described herein, the squareness SQ, and the stability and uniformity between different batches can be improved significantly.

In one aspect, the present invention provides a manufacturing method of an R-T-B permanent magnet that includes the step of: supplying a compact which is composed of an R-T-B structure, wherein R contains one or more rare-earth elements that are selected from the group consisting of Sc, La, Ce, Pr, Nd, Pm, Sm, Eu, Gd, Y, Tb, Dy, Ho, Er, Tm, Yb, and Lu (preferably containing at least Nd or Pr); T includes one or more transition metal elements (e.g., Fe and/or Co, and optionally contains one or more elements selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W); and B is boron. In some embodiments, at least a portion of B can be substituted by carbon or nitrogen.

In some embodiments, the manufacturing method can include sintering the compact at a suitable temperature (e.g., 900-1040° C.) to obtain a pre-sintered block. In some embodiments, the manufacturing method can include sintering the compact to obtain a pre-sintered block having a density of 6-7.4 g/cm$^3$. The pre-sintered block can then be coated with a heavy rare earth compound powder, sintered again (during which thermal diffusion of heavy rare earth elements into the magnet can occur) to obtain the R-T-B permanent magnet, wherein the R contains at least one heavy rare earth element (e.g., Sc, Y, Gd, Tb, Dy, Ho, Er, Tm, Yb, and Lu) and at least one rare earth element other than heavy rare earth elements (e.g., a light rare earth element such as La, Ce, Pr, Nd, Pm, Sm and Eu).

In some embodiments, the actual density of the pre-sintered block is 80-98% (e.g., 85-97%) of the theoretical density (i.e., about 7.55 g/cm$^3$). In some embodiments, the actual density of the pre-sintered block can be 6.0-7.4 g/cm$^3$.

In some embodiments, the heavy rare earth compound powder contains one or more of heavy rare earth oxides, fluorides, oxyfluorides or hydrides, rare earth intermetallics containing heavy rare earth element, heavy rare earth R2Fe14B-type compounds, or heavy rare earth nitrate hydrate salts.

In some embodiments, the heavy rare earth compound powder contains one or more of Dy, Tb or Ho.

In some embodiments, the compact is prepared by the following steps:

(1) forming a strip piece from starting materials (which can include compounding the starting materials, melting the compounded mixture, and casting the melted mixture to form the strip piece);

(2) pulverizing the strip piece by hydrogen decrepitation to obtain a coarse powder;

(3) pulverizing the coarse powder by jet-milling to obtain a fine powder having a particle size D50 of 3~6 μm; and (4) pressing the fine powder to form the compact.

In some embodiments, the coarse powder can have a hydrogen concentration in the range of 800-3000 ppm (e.g., 1000-2000 ppm).

In some embodiments, the compact can be sintered in vacuum or inert gas to obtain the pre-sintered block.

In some embodiments, coating the pre-sintered block includes dispersing the heavy rare earth compound powder in an organic solvent to prepare a slurry and immersing the pre-sintered block into the slurry.

In some embodiments, sintering the coated block includes heating the coated block at a first temperature (e.g., 820-950° C.) under vacuum (e.g., in a loosely covered metal container in a vacuum furnace), cooling, and heating the coated block at a second temperature (e.g., 450° C~620° C.) under vacuum to obtain the R-T-B permanent magnet. During the above heating processes, heavy rare earth elements (e.g., Dy, Tb or Ho) on the surface of the coated block can be diffused into the magnet.

In some embodiments, the heavy rare earth compound powder is dispersed into the organic solvent at a concentration of 0.01-1.0 g/ml.

In some embodiments, wherein the container can include a mixed powder as a sintering aid at the bottom and the mixed powder can include 10-20% of alumina and 80-90% of magnesium oxide.

In another aspect, the present invention provides an article that includes a R-T-B permanent magnet, in which R contains one or more rare-earth elements selected from the group consisting of Sc, La, Ce, Pr, Nd, Pm, Sm, Eu, Gd, Y, Tb, Dy, Ho, Er, Tm, Yb, and Lu, and R contains at least one heavy rare earth element and at least one rare earth element other than a heavy rare earth element; T contains one or more transition metal elements (such as those described above); and B is boron and. In the area that is within 1000 μm of a surface of the article, the average concentration of heavy rare earth elements in grain boundary is at least 0.7 wt % higher than that in grain center (i.e., the main phase of the permanent magnet). In some embodiments, the R-T-B permanent magnet can have a coercivity of at least about 14 MA/m.

OBJECTS OF THE INVENTION

An objective of the present invention is to provide a method for improving the diffusion of heavy rare earth elements into an R-T-B permanent magnet, improving the coercivity Hcj, and improving squareness SQ by modifying the structure of sintered magnets. Another object of the present invention is to provide a R-T-B permanent magnet having improved coercivity Hcj and/or improved squareness SQ.

Compared with magnets produced by conventional methods, the diffusion of heavy rare earth elements along the direction of orientation in the matrix in magnets produced using the methods disclosed herein is more consistent and the squareness SQ is improved significantly. In addition, the manufacturing methods described herein can significantly improve the consistency between different batches in a continuous production process.

BRIEF DESCRIPTION OF THE DRAWINGS

FIG. 1 illustrates the microstructures of magnets after thermal diffusion as described in Example 4 and Comparative Example 4-2.

DISCLOSURE OF THE INVENTION

In general, the R-T-B permanent magnets described herein are formed of a sintered body which includes a main phase composed of $R_2T_{14}B$ (which possesses excellent magnetic properties) and an R-rich phase including a larger amount of R than the main phase. The R-rich phase is present in the grain boundary of the main phase and is also referred to as a grain boundary phase. The molar ratios of Nd, Fe, and B are typically adjusted to be as close to $R_2T_{14}B$ as possible, in order to increase the ratio of the main phases in the structure of an R-T-B magnet. When R is Nd and T is Fe, the crystal lattice constant of $Nd_2Fe_{14}B$ phase is a~0.88 nm and c~1.22 nm. The theoretical density of $Nd_2Fe_{14}B$ phase is 7.62 g/cm$^3$. The Nd-rich phase has a crystal lattice constant of a~0.37 nm and c~1.18 nm. The thickness of Nd-rich phase is about 2~3 nm. The morphology of the R-rich phase and $R_2T_{14}B$ grain interface is an important factor controlling the resistance to demagnetization. In some embodiments, the R-T-B permanent magnets may also include a B-rich phase or impurities-rich phase (e.g., $Nd_2O_{13}$ phase), which are non-magnetic phases. R-T-B permanent magnets have been used in motors such as the voice coil motors of hard disk drives and motors for engines of hybrid vehicles and electric vehicles.

In some embodiments, the invention provides a method of manufacturing an R-T-B permanent magnet with improved properties, which can include the following steps:

(1) supplying a compact which includes an R-T-B material, wherein R includes one or more rare-earth elements that are selected from the group consisting of Nd, Pr, La, Ce, Sm, Dy, Tb, Ho, Er, Gd, Sc, Y, and Eu (preferably containing at least Nd or Pr); and T includes one or more transition elements (e.g., Fe and/or Co, and optionally T also contains one or more elements that selected from Al, Cu, Zn, In, Si, P, S, Ti, V, Cr, Mn, Ni, Ga, Ge, Zr, Nb, Mo, Pd, Ag, Cd, Sn, Sb, Hf, Ta, and W); and B includes boron and optionally carbon and nitrogen.

(2) sintering the compact (i.e., the first sintering process) at a suitable temperature of (e.g., 900-1040° C.) to obtain a pre-sintered block;

(3) coating the pre-sintered block with a heavy rare earth compound powder to form a coated block; and (4) sintering the coated block (i.e., the second sintering process) to obtain the R-T-B permanent magnet, wherein the R contains at least one heavy rare earth element and at least one rare earth element other than heavy rare earth elements.

In some embodiments, the compact can be prepared by the following steps:

(1) forming a strip piece from starting materials (e.g., compounding the starting materials, melting the compounded mixture, and casting the melted mixture to form the strip piece);

(2) coarse crushing: pulverizing the strip pieces by hydrogen decrepitation to obtain a coarse powder;

(3) preparation of fine powder: pulverizing the coarse powder by jet-milling to obtain a fine powder having a particle size D50 of 3-6 μm; and (4) pressing the fine powder to form the compact.

To form the strip piece, starting materials can first be mixed and compounded at a certain ratio. The compounded mixture can then be melted in a furnace and cast with a copper line speed of at least 1 m/s, which results in a strip piece with a thickness of 0.2-0.5 mm. Without wishing to be bound by theory, it is believed that when the strip thickness is more than 0.2 mm, the microstructure of the strip on the roll surface does not include a large amount of fine-grain region; and when the strip thickness is less than 0.5 mm, it is relatively difficult to form a large amount of coarse grain region in the microstructure of the strip on the surface opposite to the roll surface; both of which would adversely affect the subsequent particle size distribution of the heave rare earth compound powder on the surface of the strip piece.

In the coarse crushing process, the strip piece can go through a hydrogen decrepitation treatment to obtain a coarse powder. The coarse powder can have a particle size D50 of from at least 100 μm (e.g., at least 500 μm) to at most 1 mm (e.g., at most 500 μm). The hydrogen content in the coarse powder can range from 800 to 3000 ppm (e.g., 1000-2500 ppm or preferably 1000-2000 ppm) as measured by an ONH2000 analyzer made by the ELTRA company (Stevensville, Mich.). Without wishing to be bound by theory, it is believed that, when the hydrogen content is higher than or equal to 800 ppm, there is sufficient diffusion channels in the subsequent pre-sintered block; when the hydrogen content is lower than or equal to 3000 ppm, the pores in the pre-sintered block can ensure the pre-sintered block to achieve an actual density of more than 99.5% of its theoretical density. As used herein, the term "theoretical density" refers to the density of a material calculated by multiplying the volume percentage of each phase in the material and the theoretical density of each phase (which is generally known in the art). In some embodiments, when the hydrogen content in the coarse powder ranges from 1000 to 2000 ppm, the R-T-B permanent magnet subsequently formed can have an actual density more than 99.5% of the theoretical density and the pre-sintered block can have a sufficient amount of diffusion channels at the same time.

In the process of preparing the fine powder, the coarse powder can be jet-milled to form a fine powder having a particle size D50 of 3-6 μm (as measured by laser diffraction method; D50 is the value of the particle diameter at 50% in the cumulative distribution). Without wishing to be bound by theory, it is believed that, when D50 is greater than or equal to 3 μm, the concentration of nitrogen and oxygen in the sintered block is low, which will not affect the diffusion. Without wishing to be bound by theory, it is believed that, when D50 is less than or equal to 6 μm, the pre-sintered block can achieve more than 99.5% of the theoretical density by using a low temperature sintering method.

In the pressing process, the powder can be pressed in a vertical sealed compressor in a 1 T-3 T (e.g., 1.8-3 T) magnetic field to form a compact with a desired shape. It is believed that the compact has a magnetic orientation in the same direction as the magnetic field direction.

In the process of sintering the compact, the compact can be transferred to a sintering furnace under vacuum or in an inert gas atmosphere. This pre-sintering process can be carried out below the theoretical sintering temperature to form a pre-sintered block having a density of 80%-98% (e.g., 85-97%) of its theoretical density, which can form a sufficient amount of diffusion channels for subsequent diffusion of heavy rare earth elements. The sintering temperature can be 900-1040° C. (e.g., preferably 910-990° C.). For example, the sintering temperature in the pre-sintering process can be at least 900° C. (e.g., at least 910° C., at least 920° C., at least 930° C., at least 940° C., at least 950° C., at least 960° C., or at least 970° C.) and/or at most about 1040° C. (e.g., at most 1030° C., at most 1020° C., at most 1010° C., at most 1000° C., at most 990° C., at most 980° C., or at most 970° C.).

The sintering time in the pre-sintering process can be 1-4 hours (e.g., preferably 2-3 hours). For example, the sintering time can be at least 1 hour (e.g., at least 1.5 hours, at least 2 hours, at least 2.5 hours, or at least 3 hours) and/or at most about 4 hours (e.g., at most 3.5 hours, at most 3 hours, at most 2.5 hours, at most or at most 2 hours).

Without wishing to be bound by theory, it is believed that the sintering temperature and sintering time should be controlled in suitable ranges (such as those mentioned above) to avoid obtain a pre-sintered block having actual density that is too low or too close to the theoretical density.

The actual density of the pre-sintered block can be 6.0~7.4 g/cm$^3$, such as 6.5~7.3 g/cm$^3$. For example, the actual density can be at least 6 g/cm$^3$ (e.g., at least 6.1 g/cm$^3$, at least 6.2 g/cm$^3$, at least 6.3 g/cm$^3$, at least 6.4 g/cm$^3$, at least 6.5 g/cm$^3$, at least 6.6 g/cm$^3$, or at least 6.7 g/cm$^3$) and at most about 7.4 g/cm$^3$ (e.g., at most 7.3 g/cm$^3$, at most 7.2 g/cm$^3$, at most 7.1 g/cm$^3$, at most 7 g/cm$^3$, at most 6.9 g/cm$^3$, at most 6.8 g/cm$^3$, or at most 6.7 g/cm$^3$). Without wishing to be bound by theory, it is believed that, when the density of the pre-sintered block is greater than 6.0 g/cm$^3$, the pre-sintered block in subsequent diffusion process cannot be easily oxidized to cause poor performance; when the density of the pre-sintered block is less than 7.4 g/cm$^3$, the pre-sintered block in subsequent diffusion process could significantly improve the diffusion of heavy rare earth elements due to the presence of a sufficient amount of diffusion channels. The average grain size of the pre-sintered block is 1.1~1.5 times (e.g., 1.2~1.4 times) of the particle size D50 of the fine powders. Without wishing to be bound by theory, it is believed that the manufacturing method described herein can produce a compact having a small grain size and having a rare earth element phase that is distributed more uniformly, which can facilitate the subsequent diffusion of heavy rare earth elements.

The coating and second sintering (which includes thermal diffusion) can be performed using the following steps:

In the coating process, the pre-sintered block can first be machined into a desired shape. The heavy rare earth compound powder can be dispersed in an organic solvent to form a slurry. The machined pre-sintered block can then be immersed into the slurry to form a coated block in which heavy rare earth compound powder is coated onto the pre-sintered block. The coated block can then be transferred into a container (e.g., a loosely covered metal container).

In the second sintering process, the above container can be placed in a vacuum furnace, which can then be vacuumed (e.g., at a vacuum level of less than $10^{-2}$ Pa) and heated to a first temperature (e.g., 820-950° C. or 850-940° C.) for a sufficient amount of time. For example, the sintering temperature in the second sintering process can be at least 820° C. (e.g., at least 830° C., at least 840° C., at least 860° C., at least 860° C., at least 870° C., at least 880° C., or at least 890° C.) and/or at most about 950° C. (e.g., at most 940° C., at most 930° C., at most 920° C., at most 910° C., at most 900° C., at most 890° C., or at most 870° C.). During this process, the first diffusion occurs by diffusing the heavy rare earth elements in the heavy rare earth compound powder into the coated block. The container can subsequently be cooled (e.g., to room temperature).

This process can optionally be repeated by vacuum the container and heating the container to a second temperature (e.g., 450-620° C. or 460-550° C.) for a sufficient amount of time, during which the second diffusion of heavy rare earth elements occurs. For example, the sintering temperature in this process can be at least 450° C. (e.g., at least 460° C., at least 470° C., at least 480° C., at least 490° C., at least 500° C., at least 510° C., or at least 520° C.) and at most about 620° C. (e.g., at most 610° C., at most 600° C., at most 590° C., at most 580° C., at most 570° C., at most 560° C., or at most 550° C.). The container can then be cooled to obtain the R-T-B permanent magnet.

During the machining process, the pre-sintered block can be machined into a desired shape with a size (e.g., a size in the magnetic orientation) less than or equal to 10 mm (e.g., less than or equal to 5 mm).

In the coating process, the heavy rare earth compound powder can be dispersed in the organic solvent to obtain a slurry. The pre-sintered block can be immersed into slurry under ultrasonic stirring and then put into a container (e.g., a metal container).

In the coating process, the heavy rare earth compound powder can contain one or more of heavy rare earth oxides, fluorides, oxyfluorides, or hydrides, rare earth intermetallics containing heavy rare earth element, heavy rare earth R2Fe14B compounds, heavy rare earth nitrate hydrates. For example, the heavy rare earth compound powder can include rare earth intermetallics, such as $DyAl_2$, $MgCu_2$ type of rare earth intermetallics. For example, the heavy rare earth compound powder can include heavy rare earth oxides, fluorides, oxyfluorides, or hydrides, such as $DyF_3$, $Dy_2O_3$, DyHx, $TbF_3$, $Tb_2O_3$, $HoF_3$, and DyFO.

In the coating process, the heavy rare earth compound powder can be dispersed in the organic solvent at a concentration of 0.01-1.0 g/ml (e.g., 0.1-0.8 g/ml). Without wishing to be bound by the theory, it is believed that, within this concentration range, the heavy rare earth compound powder is sufficiently dissolved in the solvent and the powder coated on the pre-sintered block can be evenly distributed on its surface.

Particle size of the powder coated on the pre-sintered block can be in the range of 1~50 μm, more preferably in the range of 3~25 μm.

In the coating process, the organic solvent can be selected from alcohols, alkanes containing 5 to 16 carbon atoms, or esters. Examples of suitable organic solvents include ethyl acetate, ethanol, and cyclohexane.

In some embodiments, the container can include a mixed powder at the bottom of the container. The mixed powder can include 10-20% alumina and 80-90% magnesium oxide. In the second sintering process, the mixed powder can be used as a sintering aid, which can allow the pre-sintered block to quickly reach more than 99.5% of the theoretical density in 24 hours at the low temperature of 820-950° C.

In the second sintering process, the container can be vacuumed in a vacuum furnace, then heated up to a first temperature (e.g., 820-950° C.) for a sufficient time, during which the first diffusion process of heavy rare earth elements into the coated block occurs. Subsequently, the coated block can be quenched to a temperature below 80° C. by Ar gas using an Ar gas blower. A second diffusion process can be performed by heating the container at a second temperature (e.g., 450° C~620° C.) under vacuum. The coated block can then be quenched to a temperature below 80° C. by Ar gas to obtain an R-T-B permanent magnet. The permanent magnet can have a density that is 99.5% of the theoretical density after thermal diffusion treatment. It is believed that an aging process is also completed during the diffusion process. The manufacturing method described can produce an R-T-B magnet with a remarkable increase of coercivity Hcj (e.g., at least 2.4 MA/m) and having a substantially uniform distribution of the heavy rare earth elements in the grain boundary. In the second sintering process, the holding time of the first diffusion can be 12-24 hours (e.g., 12-20 hours). The holding time of the second time diffusion can be 1-8 hours (e.g., 2-7 hours).

Without wishing to be bound by theory, it is believed that the grain size of the pre-sintered block with low density is not changed in the second sintering process. It is believed that, when the time of the first diffusion is more than 12 hours, the pre-sintered block can reach more than 99.5% of theoretical density and the consistency of diffusion depth and diffusion uniformity of the heavy rare earth elements can be ensured. It is also believed that, when the time of first diffusion is less than 24 hours, the pre-sintered block does not have abnormal gain growth that leads to deterioration of magnetic properties. By contrast, although a conventional method for manufacturing a high density magnet may achieve a uniform diffusion of heavy rare earth elements after performing the first thermal diffusion for 12 hours, such a method forms a magnet having abnormal grain growth that leads to deterioration of magnetic properties. In other words, a conventional manufacturing method can only form high density magnets having one of the two, but not both, effects (i.e., diffusion uniformity and low abnormal grain growth).

In the diffusion process, the first and second diffusion processes can be carried out under a vacuum of less than 0.2 Pa. Typically, the first diffusion is performed at a temperature between 820 and 950° C. If the temperature is higher than 950° C., it is believed that the diffusion effect may not be achieved.

In addition, after analyzing the cross-section of a R-T-B permanent magnet produced by the method described herein, it is found that the R-T-B permanent magnet can have the following advantages: 1) After coating the heavy rare earth compound powder onto a pre-sintered block and second sintering process, the heavy rare earth elements are diffused more evenly in the magnet. The heavy rare earth elements gradient along the depth of the magnet is less than that in a magnet having a density above 99.5% of theoretical density and produced by a conventional manufacturing technique after the same diffusion process. 2) In the area that is within 1000 μm of the surface, the average concentration of heavy rare earth elements in grain boundary is at least 0.7 wt % higher than that in grain center. By contrast, in the same area in a magnet having a density above 99.5% of theoretical density and produced by a conventional method, the difference between the average concentration of heavy rare earth elements in grain boundary and that in grain center is less than 0.7 wt %. 3) When coated with the same amount of heavy rare earth compound powder under the same coating conditions, the pre-sintered block described herein can achieve a deeper diffusion of heavy rare earth elements compared to a magnet produced in a method that does not include a first sintering process.

In some embodiments, the R-T-B permanent magnet can include at least 28 wt % (e.g., at least 28.5 wt %, at least 29 wt %, at least 29.5 wt %, or at least 30 wt %) and/or at most 32 wt % (e.g., at most 31.5 wt %, at most 31 wt %, at most 30.5 wt %, or at most 30 wt %) of R. In some embodiments, the R-T-B permanent magnet can include at least 0.9 wt % (e.g., at least 0.92 wt %, at least 0.94 wt %, at least 0.96 wt %, at least 0.98 wt %, or at least 1 wt %) and/or at most 1.1 wt % (e.g., at most 1.08 wt %, at most 1.06 wt %, at most 1.04 wt %, at most 1.02 wt %, or at most 1 wt %) of B. In some embodiments, the R-T-B permanent magnet can include at least 67 wt % (e.g., at least 67.5 wt %, at least 68 wt %, at least 68.5 wt %, or at least 69 wt %) and/or at most 71 wt % (e.g., at most 70.5 wt %, at most 70 wt %, at most 69.5 wt %, or at most 69 wt %) of T.

In some embodiments, the R-T-B permanent magnet prepared by the method described herein can have a coercivity of at least about 14 MA/m (e.g., at least about 14.5 MA/m, at least about 15 MA/m, at least about 15.5 MA/m, at least about 16 MA/m, at least about 16.5 MA/m, or at least about 17 MA/m).

The magnetic properties described herein are measured according to the test methods described in GB/T 3217-2013.

EXAMPLES

Example 1

An alloy containing the following metal elements: PrNd (30 wt %), Dy (0.5 wt %), Al (0.4 wt %), Co (1 wt %), Cu (0.1 wt %), Ga (0.1 wt %), B (0.96 wt %), Fe (the balance) was prepared as a starting material. The purity of the metal elements was above 99%. A strip piece of the alloy with a thickness of 0.25 mm was produced using a strip casting method. The strip piece was then converted to a coarse powder having a hydrogen content of 1400 ppm by using a hydrogen decrepitation method. A fine powder having a particle size D50 of 4.5 μm was prepared from the coarse powder by using a jet-milling method. The fine powder was pressed to form a compact by using a vertical sealed compressor in a 2 T magnetic field. The compact was transferred to a high vacuum furnace for sintering at a temperature of 1000° C. for 2 hours. The density of the obtained pre-sintered block was 7.3 g/cm$^3$, which was 96.7% of theoretical density. The average grain diameter was 6.75 μm. The pre-sintered block was cut into cylinders with a dimension of D10 mm×5 mm (in which the oriented direction was 5 mm in length). A heavy rare earth compound powder (which had a particle size of 1 μm) containing 70 wt % of dysprosium nitrate and 30 wt % of dysprosium fluoride was dispersed into ethyl acetate at a concentration of 0.05 g/ml to obtain a slurry. The pre-sintered block was then immersed into the slurry for 15 minutes. Thereafter, the coated pre-sintered block was put into a metal container. A mixed powder containing 15 wt % alumina and 85 wt % magnesium oxide was placed at the bottom of the container to serve as a sintering aid. The container was transferred into a vacuum sintering furnace, in which the coated pre-sintered block was sintered under vacuum ($10^{-2}$ Pa) at a temperature of 890° C. for 12 hours. After cooling, the magnet was annealed at 500° C. for 5 hours, and followed by cooling to obtain an R-T-B permanent magnet. After the above sintering and diffusion processes, the density of the magnet was 7.52 g/cm$^3$, which reached to 99.6% of theoretical density. The average main phase grain size of the magnet was 6.80 μm. Magnetic properties of the magnet were measured and are shown in Table 1.

Comparative Example 1-1

A compact was prepared using the same conditions and process as Example 1. The compact was then transferred into a high vacuum furnace and sintered at 1050° C. (which was higher than the temperature used in Example 1) for 3 hours (which was longer than the time used in Example 1). In addition, the compact was not coated with a heavy rare earth compound powder. Subsequently, the two-step treating process was performed. In the first step, the heat treatment was carried out at 890° C. for 3 hours; in the second step, the heat treatment was carried out at 500° C. for 5 hours. Thereafter, the obtained block was cut into cylinders with a dimension of D10 mm×5 mm. The density of the product was 7.54 g/cm$^3$, which reached to 99.9% of the theoretical density. The average main phase grain diameter of product was 7.90 μm. Magnetic properties of the product were measured and are shown in Table 1.

Comparative Example 1-2

A magnet was prepared in the same manner as that in Example 1 except that the compact was sintered at 1050° C. to obtain a pre-sintered block.

Specifically, a compact was prepared using the same conditions and processes as in Example 1. The compact was transferred into a high vacuum sintering furnace and sintered at 1050° C. for 3 hours to obtain a pre-sintered block having an actual density of 7.54 g/cm$^3$, which is close to the theoretical density. The pre-sintered block was cut into cylinders with a dimension of D10 mm×5 mm. A heavy rare earth compound powder (which had an average particle size of 1 μm) containing 70 wt % of dysprosium nitrate and 30 wt % of dysprosium fluoride was dispersed into ethyl acetate at a concentration of 0.05 g/ml to obtain a slurry. The pre-sintered block was immersed into the slurry for 15 minutes. Subsequently, the coated block was put into a metal container identical to that used in Example 1. The container was transferred into a vacuum sintering furnace, in which the coated pre-sintered block was sintered under vacuum ($10^{-2}$ Pa) at 890° C. for 3 hours. After cooling, the magnet was annealed at 500° C. for 5 hours. The density of the magnet was 7.54 g/cm$^3$, which reached to 99.9% of the theoretical density. Magnetic properties of the product were measured and are shown in Table 1.

TABLE 1

Magnetic properties of the magnets obtained from Example 1, Comparative Example 1-1 Comparative Example 1-2

| | The magnetic properties of examples | | | |
|---|---|---|---|---|
| | Br (T) | Hcj (MA/m) | (BH)max (kJ/m$^3$) | HK/Hcj |
| Example 1 | 1.375 | 16.02 | 369.50 | 0.96 |
| Comparative Example 1-1 | 1.380 | 12.34 | 375.31 | 0.91 |
| Comparative Example 1-2 | 1.375 | 15.86 | 370.46 | 0.90 |

Note:
(BH)max refers to maximum energy product and HK refers to the demagnetization field that reduces the intrinsic magnetization by 10%.

As shown in Table 1, the magnet made in Example 1 exhibited significantly improved Hcj compared to the magnet made in Comparative Example 1-1. In addition, Table 1 shows that the magnet made in Example 1 exhibited significant improved HK/Hcj compared to the magnet made in Comparative Example 1-2, suggesting that the former magnet possessed an improved distribution uniformity of the heavy rare earth elements. In other words, the magnet made in Example 1 possessed both improved coercivity Hcj and/or improved squareness SQ.

Example 2

A strip piece having a thickness of 0.50 mm was prepared by strip casting from the alloy with the same composition as Example 1. The strip piece was converted into a coarse powder having a hydrogen content of 800 ppm by hydrogen decrepitation. A fine powder having a particle size D50 of 6.0 μm was prepared from the coarse powder by using ajet-milling method. The fine powder was pressed to form a compact by using a vertical sealed compressor in a 2 T magnetic field. The compact was transferred into a high vacuum sintering furnace and sintered at a temperature of 900° C. for 4 hours. The density of the obtained pre-sintered block was 6.90 g/cm$^3$, which reached to 91.4% of the theoretical density. The average grain size of the pre-sintered block was 7.30 μm. A heavy rare earth compound powder having a particle size of 50 μm and containing 100% of dysprosium oxide was dispersed into ethanol at a concentration of 0.01 g/ml to obtain a slurry. The pre-sintered block was immersed into the slurry for 60 minutes and the coated block was put into a metal container. A mixed powder containing 20 wt % alumina and 80 wt % of magnesium oxide was placed at the bottom of the container to serve as a sintering aid. The container was transferred into a vacuum sintering furnace, in which the coated pre-sintered block was sintered under vacuum ($10^{-2}$ Pa) at 950° C. for 24 hours. After cooling, the magnet was annealed at 450° C. for 8 hours, followed by cooling to obtain an R-T-B permanent magnet. The density of the obtained magnet was 7.52 g/cm$^3$, which reach to 99.6% of the theoretical density. The average main phase grain size of the magnet was 7.30 μm. Magnetic properties of the product were measured and are shown in Table 2.

Comparative Example 2-1

A compact was prepared using the same conditions and process as Example 2. The compact was then transferred into a high vacuum sintering furnace and sintered at 1070° C. (which was higher than the temperature used in Example 2) for 3 hours. In addition, the compact was not coated with a heavy rare earth compound powder. Subsequently, the two-step treating process was performed. In the first step, the heat treatment was carried out at 950° C. for 3 hours; in the second step, the heat treatment was carried out at 450° C. for 8 hours. The obtained block was cut into cylinders with a dimension of D10 mm×5 mm and the density of magnet was 7.54 g/cm$^3$. The average main phase grain size of the magnet was 10.20 μm. Magnetic properties of the product were measured and are shown in Table 2.

Comparative Example 2-2

A magnet was prepared in the same manner as that in Example 2 except that the compact was sintered at 1070° C. to obtain a pre-sintered block.

A compact was prepared using the same conditions and process as Example 2. The compact was then transferred into a high vacuum sintering furnace and sintered at 1070° C. for 3 hours to obtain a pre-sintered block having an actual density of 7.54 g/cm$^3$, which is close to the theoretical density. The block was cut into cylinders with a dimension of D10 mm×5 mm. A heavy rare earth compound powder containing 100% of dysprosium oxide was dispersed into ethanol at a concentration of 0.01 g/ml to obtain a slurry. The pre-sintered block was immersed into the slurry for 60 minutes and the coated block was put into a metal container identical to that used in Example 2. The container was transferred into a vacuum sintering furnace, in which the coated pre-sintered block was sintered under vacuum ($10^{-2}$ Pa) at 950° C. for 3 hours. After cooling, the magnet was annealed at 450° C. for 8 hours. The density of the obtained product was 7.54 g/cm$^3$. Magnetic properties of the product were measured and are shown in Table 2.

TABLE 2

Magnetic properties of the magnets obtained from Example 2, Comparative Example 2-1 and Comparative Example 2-2

| | The magnetic properties of examples | | | |
|---|---|---|---|---|
| | Br (T) | Hcj (MA/m) | (BH)max (kJ/m$^3$) | HK/Hcj |
| Example 2 | 1.376 | 14.88 | 368.95 | 0.97 |
| Comparative Example 2-1 | 1.380 | 12.00 | 374.28 | 0.91 |
| Comparative Example 2-2 | 1.378 | 14.77 | 369.98 | 0.90 |

As shown in Table 2, the magnet made in Example 2 exhibited significantly improved Hcj compared to the magnet made in Comparative Example 2-1. In addition, Table 2 shows that the magnet made in Example 2 exhibited significantly improved HK/Hcj compared to the magnet made in Comparative Example 2-2, suggesting that the former magnet possessed an improved distribution uniformity of the heavy rare earth elements. In other words, the magnet made in Example 2 possessed both improved coercivity Hcj and/or improved squareness SQ.

Example 3

A strip piece having a thickness of 0.20 mm was prepared by strip casting from an alloy having the same composition as in Example 1. The strip was converted by hydrogen decrepitation to a coarse powder having hydrogen content of 3000 ppm. A fine powder having a particle size D50 of 3.0 μm was prepared from the coarse powder by jet-milling. The fine powder was pressed to form a compact by using a vertical sealed compressor in a 2 T magnetic field. Subsequently, the pressed compact was transferred into a high vacuum sintering furnace and sintered at 950° C. for 1 hour. The density of the obtained pre-sintered block was 6.50 g/cm$^3$, which was 86.1% of the theoretical density. The average grain size of the pre-sintered block was 3.3 μm. The block was then cut into cylinders with a dimension of D10 mm×5 mm (in which the orientation direction was 5 mm in length). A heavy rare earth compound powder having a particle size of 25 μm and containing 20 wt % of DyHx and 80 wt % of $MgCu_2$ intermetallic compound (which included 10 wt % of Nd, 12 wt % of Pr, 35 wt % of Dy, 41 wt % of Fe, and 2 wt % of Co) was dispersed into ethanol at a concentration of 1 g/ml to obtain a slurry. The cylindrical block was immersed into the slurry for 30 minutes and the coated block was put into a metal container. A mixed powder containing 15 wt % of alumina and 85 wt % of magnesium oxide was placed at the bottom of the container to serve as a sintering aid. The container was transferred into a vacuum sintering furnace, in which the coated pre-sintered block was sintered under vacuum ($10^{-2}$ Pa) at 920° C. for 15 hours. After cooling, the magnet was annealed at 480° C. for 5 hours, and then cooled to obtain an R-T-B permanent magnet. The density of the magnet was 7.54 g/cm$^3$, which was 99.9% of the theoretical density. The average main phase grain size of the magnet was 3.60 μm. Magnetic properties of the product were measured and are shown in Table 3.

Comparative Example 3-1

A compact was prepared using the same conditions and process as in Example 3 and put into a high vacuum sintering furnace. The compact was sintered at a temperature of 1045° C. (which was higher than the temperature used in Example 3) for 3 hours (which was longer than the time used in Example 3). In addition, the compact was not coated with a heavy rare earth compound powder. Subsequently, the two-step treating process was performed. The first heat treatment process was carried out at 920° C. for 3 hours and the second heat treatment process was carried out at 480° C. for 5 hours. The resulting block was cut into cylinders with a dimension of D10 mm×5 mm. The density of the product was 7.54 g/cm$^3$ and the average main phase grain size was 5.80 μm. Magnetic properties of the product were measured and are shown in Table 3.

Comparative Example 3-2

A magnet was prepared in the same manner as that in Example 3 except that the compact was sintered at 1045° C. to obtain a pre-sintered block.

Specifically, a compact was prepared using the same conditions and process as Example 3 and transferred into a high vacuum sintering furnace. The compact was sintered at 1045° C. for 3 hours to obtain a pre-sintered block having an actual density of 7.54 g/cm$^3$, which is close to the theoretical density. The block was cut into cylinders with a dimension of D10 mm×5 mm. A heavy rare earth compound powder having a particle size of 25 μm and containing 20 wt % of DyHx and 80 wt % of $MgCu_2$ intermetallic compound (which included 10 wt % of Nd, 12 wt % of Pr, 35 wt % of Dy, 41 wt % of Fe, and 2 wt % of Co) was dispersed into ethanol at a ratio of 1 g/ml to obtain a slurry. The cylindrical pre-sintered block was immersed into the slurry for 30 minutes and the coated block was put into a metal container identical to that used in Example 3. The container was transferred into a vacuum sintering furnace, in which the coated pre-sintered block was sintered under vacuum ($10^{-2}$ Pa) at 920° C. for 15 hours. After cooling, the magnet was annealed at 480° C. for 5 hours. The density of the product was 7.54 g/cm$^3$. Magnetic properties of the product were measured and are shown in Table 3.

TABLE 3

Magnetic properties of the magnets obtained from Example 3, Comparative Example 3-1 and Comparative Example 3-2.

| | The magnetic properties of examples | | | |
|---|---|---|---|---|
| | Br (T) | Hcj (MA/m) | (BH)max (kJ/m$^3$) | HK/Hcj |
| Example 3 | 1.375 | 17.58 | 367.67 | 0.97 |
| Comparative example 3-1 | 1.378 | 12.78 | 373.24 | 0.93 |
| Comparative example 3-2 | 1.375 | 17.46 | 368.07 | 0.80 |

As shown in Table 3, the magnet made in Example 3 exhibited significantly improved Hcj compared to the magnet made in Comparative Example 3-1. In addition, Table 3 shows that the magnet made in Example 3 exhibited significant improved HK/Hcj compared to the magnet made in Comparative Example 3-2, suggesting that the former magnet possessed an improved distribution uniformity of the heavy rare earth elements. In other words, the magnet made in Example 3 possessed both improved coercivity Hcj and/or improved squareness SQ.

Example 4

A strip piece having a thickness of 0.25 mm was prepared by strip casting from an alloy having the same composition as Example 1. The strip piece was converted to a coarse powder having a hydrogen content of 1000 ppm by hydrogen decrepitation. A fine powder having a particle size of D50=4.5 μm was prepared from the coarse powder by jet-milling. The fine powder was pressed to form a compact by using a vertical sealed compressor in a 2 T magnetic field. The compact was then transferred into a high vacuum sintering furnace and sintered at 920° C. for 4 hours. The density of the obtained compact was 7.00 g/cm$^3$, which was 92.7% of the theoretical density. The average grain size of the pre-sintered block was 6.30 μm. The block was cut into cylinders with a dimension of D10 mm×5 mm (in which the orientation direction was 5 mm in length). A heavy rare earth compound powder having a particle size of 3 μm and containing 20 wt % of terbium fluoride, 20 wt % of $Dy_2Fe_{14}B$, and 60 wt % of $MgCu_2$ type intermetallic compound (which included 10 wt % Nd, 15 wt % Pr, 25 wt % Dy, 7 wt % Tb, 41.9 wt % Fe, 1 wt % Co, and 0.1 wt % Cu) was dispersed into ethanol to obtain a slurry. The coated pre-sintered block was put into a metal container. A mixed powder containing 10 wt % of alumina and 90 wt % of magnesium oxide was placed at the bottom of the container to serve as a sintering aid. The container was transferred into a vacuum sintering furnace, in which the coated pre-sintered block was sintered under vacuum ($10^{-2}$ Pa) at 820° C. for 20 hours. After cooling, the block was annealed at 620° C. for 3 hours, followed by cooling to form a R-T-B permanent magnet. The density of the obtained magnet was 7.54 g/cm$^3$, which was 99.6% of the theoretical density. The average main phase grain size of the magnet was 6.45 μm. Magnetic properties of the product were measured and are shown in Table 4.

Comparative example 4-1

A compact was prepared using the same conditions and process as in Example 4 and transferred to high vacuum sintering furnace. The compact was sintered at 1060° C. for 3 hours. Subsequently, the two-step treating diffusion process was performed. In the first step, the pre-sintered block was annealed at 820° C. for 2 hours; in the second step, it was annealed at 620° C. for 3 hours. The obtained block was cut into cylinders with a dimension of D10 mm×5 mm. The density of the magnet was 7.54 g/cm$^3$. The average main phase grain size of the magnet was 7.25 μm. Magnetic properties of the product were measured and are shown in Table 4.

Comparative example 4-2

A magnet was prepared in the same manner as that in Example 4 except that the compact was sintered at 1060° C. to obtain a pre-sintered block.

Specifically, a compact was prepared using the same conditions and process as Example 4 and transferred into a high vacuum sintering furnace. The compact was sintered at 1060° C. for 3 hours to obtain a pre-sintered block having an actual density of 7.54 g/cm$^3$, which is close to the theoretical density. The compact was not coated with a heavy rare earth compound powder. The pre-sintered block was cut into cylinders with a dimension of D10 mm×5 mm. A heavy rare earth compound powder having a particle size of 3 μm and contained 20 wt % terbium fluoride, 20 wt % $Dy_2Fe_{14}B$, and 60 wt % $MgCu_2$ intermetallic compound (which included 10 wt % Nd, 15 wt % Pr, 25 wt % Dy, 7 wt % Tb, 41.9 wt % Fe, 1 wt % Co, and 0.1 wt % of Cu) was dispersed into ethanol at a concentration of 0.1 g/ml to obtain a slurry. The cylindrical pre-sintered block was immersed into the slurry for 15 minutes and the coated block was put into a metal container identical to that used in Example 4. The container was transferred into a vacuum sintering furnace, in which the coated pre-sintered block was sintered under vacuum ($10^{-2}$ Pa) at 820° C. for 2 hours. After cooling, the block was annealed at 620° C. for 3 hours. The density of the obtained product was 7.54 g/cm$^3$. Magnetic properties of the product were measured and are shown in Table 4.

TABLE 4

Magnetic properties of the magnets obtained from Example 4, Comparative Example 4-1 and Comparative Example 4-2.

| | The magnetic properties of examples | | | |
|---|---|---|---|---|
| | Br (T) | Hcj (MA/m) | (BH)max (kJ/m$^3$) | HK/Hcj |
| Example 4 | 1.375 | 16.53 | 367.67 | 0.98 |
| Comparative example 4-1 | 1.378 | 12.62 | 373.24 | 0.93 |
| Comparative example 4-2 | 1.375 | 16.50 | 368.07 | 0.91 |

As shown in Table 4, the magnet made in Example 4 exhibited significantly improved Hcj compared to the magnet made in Comparative Example 4-1. In addition, Table 4 shows that the magnet made in Example 4 exhibited significant improved HK/Hcj compared to the magnet made in Comparative Example 4-2, suggesting that the former magnet possessed an improved distribution uniformity of the heavy rare earth elements. In other words, the magnet made in Example 4 possessed both improved coercivity Hcj and/or improved squareness SQ.

The microstructures at different distances from the surface in a cross-section of the magnets obtained from Example 4, Comparative Example 4-1 and Comparative Example 4-2 were observed by using Scanning Electron Microscopy (SEM, TESCAN VEGA 3 LMH), and the compositions at these locations were analyzed by Energy Dispersive Spectroscopy (EDS).

FIG. 1 includes the microstructure photos of the magnets obtained after thermal diffusion in Example 4 and Comparative Example 4-2. FIG. 1(*a*)(*b*)(*c*)(*d*) are photos obtained from the magnet described in Example 4: (a) near the surface, (b) 200 μm to the surface, (c) 500 μm to the surface, and (d) 1000 μm to the surface. FIG. 1(*e*)(*f*)(*g*)(*h*) are photos obtained from the magnet described in Comparative Example 4-2: (e) near the surface, (f) 200 μm to the surface, (g) 500 μm to the surface, and (h) 1000 μm to the surface.

TABLE 5

Dy + Tb weight percentage in the magnets obtained from Example 4 and Comparative Example 4-2

| The analysis part in the sample | The weight percentage of Dy and Tb in the analysis part in the sample | | | |
|---|---|---|---|---|
| | The grain border in Example 4 | The grain center part in Example 4 | The grain border in Comparative example 4-2 | The grain center part in Comparative example 4-2 |
| Near the surface of the sample | 9.7 | 2.61 | 13.5 | 2.41 |
| The depth part of the sample surface is 200 μm | 2.65 | 1.34 | 2.85 | 2.34 |
| The depth part of the sample surface is 500 μm | 2.24 | 1.52 | 2.75 | 2.26 |
| The depth part of the sample surface is 1000 μm | 2.27 | 1.28 | 1.82 | 1.34 |

Note:
the weight percentages of Dy + Tb in Table 5 are mean values of more than 10 grains in the same distance obtained by Energy Spectrum Scanning.

The photos in FIG. 1 and data in Table 5 show that: 1) The diffusion of heavy rare earth elements in the magnet in Example 4 was more uniform than that in the magnet in Comparative Example 4-2. The distribution gradient of heavy rare earth elements from the surface to an inner layer in the magnet in Example 4 was less than that in the magnet in Comparative Example 4-2. 2) Within the distance of nearly 1000 μm from the magnet surface, the mean content of heavy rare earth elements in grain boundary was at least 0.7 wt % higher than that in the grain center in the magnet in Example 4. However, in the magnet in Comparative Example 4, the difference in the content of heavy rare earth elements was less than 0.7 wt % between grain boundary and grain center within the 1000 μm from the magnet surface. 3) When coated with the same amount of heavy rare earth element under the same coating conditions, the diffusion depth of heavy rare earth element in magnet in Example 4 was larger than the magnet in Comparative Example 4-2.

Example 5

A strip piece having a thickness of 0.30 mm was prepared by strip casting from an alloy with the same composition as in Example 1. The strip piece was converted to a coarse powder having hydrogen content of 2000 ppm by hydrogen decrepitation. The fine powder having a particle size D50 of 4.0 μm was prepared from the coarse powder by jet-milling. Subsequently, the fine powder was pressed to form a compact by a vertical sealed compressor in a 2 T magnetic field. The compact was then transferred into a high vacuum sintering furnace and sintered at 1000° C. for 1 hour. The density of the obtained pre-sintered block was 6.75 g/cm$^3$, which was 89.4% of the theoretical density. The average grain size of the compact was 5.20 μm. The pre-sintered block was cut into cylinders with a dimension of D10 mm×5 mm (in which the orientated direction was 5 mm in length). A heavy rare earth compound powder having a particle size of 5 μm and containing 5 wt % terbium oxide, 5 wt % $DyGa_2$ and 90 wt % $MgCu_2$ intermetallic compound (which included 28 wt % Nd, 25 wt % Dy, 3 wt % Ho, 42.7 wt % Fe, 1 wt % Co, 0.1 wt % Cu, 0.1 wt % Ga, and 0.1 wt % Zr) was dispersed into cyclohexane at a concentration of 0.8 g/ml to obtain a slurry. The cylindrical pre-sintered block was immersed into the slurry for 45 minutes and the coated block was put into a metal container. A mixed powder containing 20 wt % of alumina and 80 wt % of magnesium oxide was placed at the bottom of the container to serve as a sintering aid. The container was then put into a vacuum sintering furnace, in which the coated pre-sintered block was sintered under vacuum ($10^{-2}$ Pa) at 920° C. for 18 hours. After cooling, the block was annealed at 540° C. for 5 hours, followed by cooling to obtain an R-T-B permanent magnet. The density of the magnet was 7.54 g/cm$^3$. The average main phase grain size was 5.30 μm. Magnetic properties of the product were measured and are shown in Table 6.

Comparative Example 5-1

A compact was prepared using the same conditions and process as in Example 5 and transferred into a high vacuum sintering furnace. The compact was sintered at 1060° C. (which was higher than the temperature used in Example 5) for 3 hours (which was longer than the time used in Example 5). In addition, the compact was not coated with a heavy rare earth compound powder. Subsequently, the two-step treating process was performed. In the first step, the heat treatment was carried out at 920° C. for 2 hours; in the second step, the heart treatment was carried out at 540° C. for 5 hours. The magnet thus obtained was cut into cylinders with a dimension of D10 mm×5 mm. The density of the product was 7.54 g/cm$^3$. The average main phase grain size was 7.20 μm. Magnetic properties of the product were measured and are shown in Table 6.

Comparative Example 5-2

A magnet was prepared in the same manner as that in Example 5 except that the compact was sintered at 1060° C. to obtain a pre-sintered block.

Specifically, a compact was prepared using the same conditions and process as Example 5 and put into a high vacuum sintering furnace. The compact was sintered at 1060° C. for 3 hours to obtain a pre-sintered block having an actual density of 7.54 g/cm$^3$, which is close to the theoretical density. The pre-sintered block was cut into cylinders with a dimension of D10 mm×5 mm. A heavy rare earth compound powder having a particle size of 5μm and containing 5 wt % terbium oxide, 5 wt % $DyGa_2$ and 90 wt % $MgCu_2$ intermetallic compound (which include 28 wt % Nd, 25 wt % Dy, 3 wt % Ho, 42.7 wt % Fe, 1 wt % Co, 0.1 wt % Cu, 0.1 wt % Ga, and 0.1 wt % Zr) was dispersed into cyclohexane at a concentration of 0.8 g/ml to obtain a slurry. The pre-sintered magnet was immersed into the slurry for 45 minutes and the coated block was put into a metal container identical to that used in Example 5. The container was then transferred into a vacuum sintering furnace, in which the coated pre-sintered block was sintered under vacuum ($10^{-2}$ Pa) at 920° C. for 12 hours. After cooling, the block was annealed at 540° C. for 5 hours. The density of the product was 7.54 g/cm$^3$. Magnetic properties of the product were measured and are shown in Table 6.

TABLE 6

Magnetic properties results of Example 5, Comparative Example 5-1 and Comparative Example 5-2

| | The magnetic properties of examples | | | |
|---|---|---|---|---|
| | Br (T) | Hcj (MA/m) | (BH)max (kJ/m$^3$) | HK/Hcj |
| Example 5 | 1.376 | 16.92 | 372.21 | 0.97 |
| Comparative Example 5-1 | 1.381 | 12.51 | 378.26 | 0.93 |
| Comparative Example 5-2 | 1.375 | 16.74 | 368.07 | 0.85 |

As shown in Table 6, the magnet made in Example 5 exhibited significantly improved Hcj compared to the magnet made in Comparative Example 5-1. In addition, Table 6 shows that the magnet made in Example 6 exhibited significant improved HK/Hcj compared to the magnet made in Comparative Example 6-2, suggesting that the former magnet possessed an improved distribution uniformity of the heavy rare earth elements. In other words, the magnet made in Example 6 possessed both improved coercivity Hcj and/or improved squareness SQ.

Example 6

A strip piece having a thickness of 0.25 mm was prepared by strip casting from an alloy with the same composition as Example 1. The strip piece was converted to a coarse powder having hydrogen content of 1500 ppm was prepared using hydrogen decrepitation. A fine powder having a particle size D50 of 4.0 μm was prepared using a jet-milling method. The fine powder was pressed to form a compact by a vertical sealed compressor in a 2 T magnetic field. The compact was then transferred into a high vacuum sintering furnace and sintered at 950° C. for 3 hours. The density of the pre-sintered block was 7.10 g/cm$^3$, which was 94.0% of the theoretical density. The average grain size was 5.60 μm. The pre-sintered block was cut into cylinders with a dimension of D10 mm×5 mm (in which the oriented direction is 5 mm in length). A heavy rare earth compound powder containing 10 wt % holmium nitrate, 50 wt % fluorine dysprosium oxide and 40 wt % $MgCu_2$ intermetallic compound (which included 22 wt % Pr, 30 wt % Dy, 6 wt % Ho, 38.1 wt % Fe, 3 wt % Co, 0.5 wt % Cu, 0.2 wt % Ga, 0.1 wt % Cr, and 0.1 wt % Mn) was dispersed into cyclohexane at a concentration of 0.5 g/ml to obtain a slurry. The pre-sintered block was immersed into the slurry for 30 minutes and the coated block was put into a metal container. A mixed powder containing 20 wt % alumina and 80 wt % magnesium oxide was placed at the bottom of the container to serve as a sintering aid. The container containing the coated block was put into a vacuum sintering furnace, in which the coated pre-sintered block was sintered under vacuum ($10^{-2}$ Pa) at 940° C. for 16 hours. After cooling, the block was annealed at 480° C. for 6 hours, followed by cooling to obtain an R-T-B permanent magnet. The density of the product was 7.54 g/cm$^3$. The average main phase grain size was 5.65 μm. Magnetic properties of the product were measured and are shown in Table 7.

Comparative Example 6-1

A compact was prepared using the same conditions and process as Example 6 and put into a high vacuum sintering furnace. The compact was sintered at 1060° C. (which was higher than the temperature used in Example 6) for 3 hours. In addition, the compact was not coated with a heavy rare earth compound powder. Subsequently, the two-step treating process was performed. In the first step, the block was annealed at 940° C. for 2 hours; in the second step, the block was annealed at 480° C. for 6 hours. The obtained block was cut into cylinders of dimensions D10*5 mm. The density of the product was 7.54 g/cm$^3$. The average main phase grain size was 7.20 μm. Magnetic properties of the product was measured and are shown in Table 7.

Comparative Example 6-2

A magnet was prepared in the same manner as that in Example 6 except that the compact was sintered at 1060° C. to obtain a pre-sintered block.

Specifically, a compact was prepared using the same conditions and process as Example 6 and put into a high vacuum sintering furnace. The compact was sintered at 1060° C. for 3 hours to obtain a pre-sintered block having an actual density of 7.54 g/cm$^3$, which is close to the theoretical density. The block was cut into cylinders with a dimension of D10 mm×5 mm. A heavy rare earth compound powder having a particle size of 10 μm and containing 10 wt % holmium nitrate, 50 wt % fluorine dysprosium oxide, and 40 wt % MgCu2 intermetallic compound (which included 22 wt % Pr, 30 wt % Dy, 6wt % Ho, 38.1 wt % Fe, 3 wt % Co, 0.5 wt % Cu, 0.2 wt % Ga, 0.1 wt % Cr, and 0.1 wt % Mn) was dispersed into cyclohexane at a concentration of 0.5 g/ml to obtain a slurry. The cylindrical pre-sintered block was immersed into the slurry for 30 minutes and the coated block was put into a metal container identical to that used in Example 6. The container was then transferred into a vacuum sintering furnace, in which the coated pre-sintered block was sintered under vacuum ($10^{-2}$ Pa) at 940° C. for 6 hours. After cooling, the block was annealed at 480° C. for 6 hours. The density of the product was 7.54 g/cm$^3$. Magnetic properties of the product were measured and are shown in Table 7.

TABLE 7 magnetic properties of the magnets obtained from Example 6, Comparative Example 6-1 and Comparative Example 6-2

| | The magnetic properties of examples | | | |
|---|---|---|---|---|
| | Br (T) | Hcj (MA/m) | (BH)max (kJ/m$^3$) | HK/Hcj |
| Example 6 | 1.376 | 15.99 | 372.21 | 0.98 |
| Comparative Example 6-1 | 1.381 | 12.51 | 378.26 | 0.92 |
| Comparative Example 6-2 | 1.375 | 16.04 | 368.07 | 0.91 |

As shown in Table 7, the magnet made in Example 6 exhibited significantly improved Hcj compared to the magnet made in Comparative Example 6-1. In addition, Table 7 shows that the magnet made in Example 6 exhibited significant improved HK/Hcj compared to the magnet made in Comparative Example 6-2, suggesting that the former magnet possessed an improved distribution uniformity of the heavy rare earth elements. In other words, the magnet made in Example 6 possessed both improved coercivity Hcj and/or improved squareness SQ.

Example 7

A strip piece having a thickness of 0.25 mm was prepared by strip casting from an alloy with the same composition as Example 1. The strip piece was then converted to a coarse powder having a hydrogen content of 1500 ppm by using hydrogen decrepitation. The coarse powder was jet-milled to form a fine powder having a particle size D50 of 5.40 μm. The fine powder was pressed to form a compact by a vertical sealed compressor in a 2 T magnetic field. The compact was put into a high vacuum sintering furnace and sintered at 950° C. for 3 hours. The density of the pre-sintered block was 7.10 g/cm$^3$, which was 94.0% of the theoretical density. The average grain size was 5.60 μm. The block was cut into cylinders with a dimension of D10 mm×5 mm (in which the oriented direction is 5 mm in length). A heavy rare earth compound powder having a particle size was 15 μm and containing 70 wt % of holmium nitrate pentahydrate, 20 wt % of fluorine dysprosium oxide, and 10 wt % of $MgCu_2$ intermetallic compound (which included 22 wt % Pr, 30 wt % Dy, 6 wt % Ho, 38.1 wt % Fe, 3 wt % Co, 0.5 wt % Cu, 0.2 wt % Ga, 0.1 wt % Cr, and 0.1 wt % Mn) was dispersed into cyclohexane at a concentration of 0.5 g/ml to obtain a slurry. The pre-sintered block was immersed into the slurry for 30 minutes and the coated block was put into a metal container. Subsequently, the container was transferred into a vacuum sintering furnace, in which the coated pre-sintered block was sintered under vacuum ($10^{-2}$ Pa) at 940° C. for 24 hours. After cooling, the block was annealed at 480° C. for 6 hours, followed by cooling to obtain an R-T-B permanent magnet. The density of the obtained product was 7.50 g/cm$^3$. The average main phase grain size was 5.70 μm. Magnetic properties of the product were measured and are shown in Table 8.

Comparative Example 7-1

A compact was prepared using the same conditions and process as Example 7 and put into a high vacuum sintering furnace. The compact was sintered at 1060° C. (which was higher than the temperature used in Example 7) for 3 hours. In addition, the compact was not coated with a heavy rare earth compound powder. Subsequently, the two-step treating process was performed. In the first step, the heat treatment was carried out at 940° C. for 2 hours; in the second step, the heat treatment was carried out at 480° C. for 6 hours. The resulting block was cut into cylinders of dimensions D10 mm×5 mm. The density of the product was 7.54 g/cm$^3$. The average main phase grain size was 7.20 μm. Magnetic properties of the product were measured and are shown in Table 8.

Comparative example 7-2

A magnet was prepared in the same manner as that in Example 7 except that the compact was sintered at 1060° C. to obtain a pre-sintered block.

Specifically, a compact was prepared using the same conditions and process of Example 7 and put into high vacuum sintering furnace. The compact was sintered at 1060° C. for 3 hours to obtain a pre-sintered blocks having an actual density of 7.54 g/cm$^3$, which is close to the theoretical density. The pre-sintered block was cut into cylinders with a dimension of D10mmx5mm. A heavy rare earth compound powder containing 70 wt % of holmium nitrate pentahydrate, 20 wt % of fluorine dysprosium oxide, and 10 wt % of $MgCu_2$ intermetallic compound (which included 22 wt % Pr, 30 wt % Dy, 6 wt % Ho, 38.1 wt % Fe, 3 wt % Co, 0.5 wt % Cu, 0.2 wt % Ga, 0.1 wt % Cr, and 0.1 wt % Mn) was dispersed into cyclohexane at a concentration of 0.5 g/ml to obtain a slurry. The machined pre-sintered block was immersed into the slurry for 30 minutes and the coated block was transferred into a metal container identical to that used in Example 7. The container was transferred into a vacuum sintering furnace, in which the coated pre-sintered block was sintered under vacuum ($10^{-2}$ Pa) at 940° C. for 6 hours. After cooling, the block was annealed at 480° C. for 6 hours and then cooled to room temperature to obtain the final product. The density of the product was 7.54 g/cm$^3$. Magnetic properties of the product were measured and are shown in Table 8.

TABLE 8

Magnetic properties of the magnets obtained from Example 7, Comparative Example 7-1 and Comparative Example 7-2

| | The magnetic properties of examples | | | |
|---|---|---|---|---|
| | Br (T) | Hcj (MA/m) | (BH)max (kJ/m$^3$) | HK/Hcj |
| Example 7 | 1.371 | 15.54 | 367.19 | 0.96 |
| Comparative Example 7-1 | 1.381 | 12.51 | 378.26 | 0.92 |
| Comparative Example 7-2 | 1.375 | 15.68 | 368.07 | 0.91 |

As shown in Table 8, the magnet made in Example 7 exhibited significantly improved Hcj compared to the magnet made in Comparative Example 7-1. In addition, Table 8 shows that the magnet made in Example 7 exhibited significant improved HK/Hcj compared to the magnet made in Comparative Example 8-2, suggesting that the former magnet possessed an improved distribution uniformity of the heavy rare earth elements. In other words, the magnet made in Example 8 possessed both improved coercivity Hcj and/or improved squareness SQ.

Example 8-1

The cylinders of dimensions D10 mm×5 mm products was prepared using the same method as that described in Example 4. The cylinders were coated and sintered/thermally diffused twice using the method described in Example 4 in 5 batches. The process conditions of each batch were kept the same. 50 pieces of cylinders from each batch were selected and their magnetic properties were measured to compare the consistency of their properties between different batches. The results are shown in Table 9 (in which the average value is the average obtained from the 50 pieces, and the range is the difference between the maximum value and minimum value obtained from the 50 pieces).

TABLE 9

The magnetic property results obtained from Example 8-1

| | Br (T) | | Hcj(MA/m) | | (BH) max(kJ/m$^3$) | | Hk/Hcj | |
|---|---|---|---|---|---|---|---|---|
| | Average | Range | Average | Range | Average | Range | Average | Range |
| The first batch | 1.374 | 0.006 | 16.70 | 0.22 | 372.05 | 3.34 | 0.96 | 0.01 |
| The second batch | 1.375 | 0.007 | 16.66 | 0.24 | 372.53 | 3.82 | 0.96 | 0.01 |
| The third batch | 1.374 | 0.005 | 16.63 | 0.15 | 367.35 | 3.10 | 0.96 | 0.01 |
| The fourth batch | 1.374 | 0.006 | 16.67 | 0.25 | 371.41 | 3.34 | 0.97 | 0.01 |
| The fifth batch | 1.374 | 0.006 | 16.68 | 0.20 | 372.37 | 3.34 | 0.96 | 0.01 |

Example 8-2

The cylinders of dimensions D10 mm×5 mm were prepared using the same method as that described in Comparative Example 4-2. The cylinders were coated and sintered/thermally diffused twice using the method described in Comparative Example 4-2 in 5 batches. The process conditions of the 5 batches were kept the same. 50 pieces of cylinders from each batch were selected and their magnetic properties were measured to compare consistency of their properties between different batches. The results are shown in Table 10 (in which the average value is the average obtained from the 50 pieces, and the range is the difference between the maximum value and minimum value obtained from the 50 pieces)

TABLE 10

The magnetic property results obtained from Example 8-2

| | Br (T) | | Hcj(MA/m) | | (BH) max(kJ/m$^3$) | | Hk/Hcj | |
|---|---|---|---|---|---|---|---|---|
| | Average | Range | Average | Range | Average | Range | Average | Range |
| The first batch | 1.376 | 0.007 | 16.58 | 0.76 | 373.40 | 3.58 | 0.93 | 0.04 |
| The second batch | 1.375 | 0.006 | 16.62 | 0.84 | 372.93 | 3.82 | 0.92 | 0.06 |
| The third batch | 1.375 | 0.005 | 16.52 | 0.72 | 372.13 | 3.18 | 0.93 | 0.05 |
| The fourth batch | 1.374 | 0.005 | 16.56 | 0.73 | 371.41 | 4.14 | 0.94 | 0.06 |
| The fifth batch | 1.375 | 0.006 | 16.64 | 0.69 | 372.37 | 3.82 | 0.92 | 0.04 |

As shown in Tables 9 and 10, the magnets produced by the manufacturing method disclosed herein exhibited better consistency in magnetic properties than those produced using a conventional production method.

What is claimed is:

1. A method of manufacturing a R-T-B permanent magnet, comprising the steps of:

sintering a compact comprising a R-T-B material at a temperature of between 900° C. and 1040° C. to obtain a pre-sintered block, wherein R comprises one or more rare-earth elements selected from the group consisting of Sc, La, Ce, Pr, Nd, Pm, Sm, Eu, Gd, Y, Tb, Dy, Ho, Er, Tm, Yb, and Lu, and R comprises at least one heavy rare earth element and at least one rare earth element other than a heavy rare earth element; T comprises one or more transition metal elements; and B is boron;

wherein the actual density of the pre-sintered block is 6.0-7.4 g/cm$^3$;

coating a heavy rare earth compound powder on the pre-sintered block to form a coated block; and wherein, prior to sintering the coated block, placing the coated block in a container that comprises a sintering aid comprising between 10 and 20% of alumina and between 80 and 90% of magnesium oxide, sintering the coated block to obtain the R-T-B permanent magnet, wherein sintering the coated block comprises heating the coated block at between 860° C. and 950° C. for between 12 and 24 hours under vacuum, cooling, and heating the coated block at between 450° C. and 620° C. under vacuum to obtain the R-T-B permanent magnet.

2. The method according to claim 1, wherein T comprises Fe or Co, and optionally one or more elements selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W.

3. The method according to claim 1, wherein R comprises Nd or Pr.

4. The method according to claim 1, wherein the pre-sintered block has a density of between 80% and 98% of the theoretical density.

5. The method according to claim 4, wherein the pre-sintered block has a density of between 85% and 97% of the theoretical density.

6. The method according to claim 1, wherein the heavy earth compound powder contains one or more of heavy rare earth oxides, fluorides, oxyfluorides or hydrides, rare earth intermetallics containing heavy rare earth element, heavy rare earth R2Fe14B compounds, or heavy rare earth nitrate hydrate salts.

7. The method according to claim 1, wherein the heavy rare earth compound powder comprises Dy, Tb or Ho.

8. The method according to claim 1, wherein the compact is obtained by the following steps:

forming a strip piece from an alloy;

pulverizing the strip piece by hydrogen decrepitation to obtain a coarse powder having a particle size D50 of at least 100 μm to at most 1 mm;

pulverizing the coarse powder by jet-milling to obtain a fine powder having a particle size D50 of 3~6 μm; and pressing the fine powder in a vertical sealed compressor to form the compact.

9. The method according to claim 8, wherein the coarse powder has a hydrogen concentration in the range of 800-3000 ppm.

10. The method according to claim 9, wherein the coarse powder has a hydrogen concentration in the range of 1000-2000 ppm.

11. The method according to claim 1, wherein coating the pre-sintered block comprises dispersing the heavy rare earth compound powder in an organic solvent to prepare a slurry and immersing the pre-sintered block into the slurry.

12. The method according to claim 11, wherein the heavy rare earth compound powder is dispersed into the organic solvent at a concentration of between 0.01 and 1.0 g/ml.

13. The method according to claim 1, wherein sintering the coated block comprises heating the coated block at between 860 and 950° C. for between 15 and 20 hours.

14. The method according to claim 1, wherein the method comprises pre-sintering the compact at a temperature between 910 and 990° C.

15. A method of manufacturing a R-T-B permanent magnet, comprising the steps of:

sintering a compact comprising a R-T-B material at a temperature of between 900° C. and 1040° C. to obtain a pre-sintered block, wherein R comprises one or more rare-earth elements selected from the group consisting of Sc, La, Ce, Pr, Nd, Pm, Sm, Eu, Gd, Y, Tb, Dy, Ho, Er, Tm, Yb, and Lu, and R comprises at least one heavy rare earth element and at least one rare earth element other than a heavy rare earth element; T comprises one or more transition metal elements; and B is boron;

coating a heavy rare earth compound powder on the pre-sintered block to form a coated block; and sintering the coated block to obtain the R-T-B permanent magnet, wherein sintering the coated block comprises heating the coated block at between 820° C. and 950° C. under vacuum, cooling, and heating the coated block at between 450° C. and 620° C. under vacuum to obtain the R-T-B and prior to sintering the coated block, the method further comprises placing the coated block in a container that comprises a sintering aid comprising between 10 and 20% of alumina and between 80 and 90% of magnesium oxide.

* * * * *